United States Patent [19]

Oldengott

[11] 4,406,619

[45] Sep. 27, 1983

[54] SEALING LID MEANS FOR COKE OVEN CHAMBER

[76] Inventor: Hans Oldengott, Bockumer Heide 18, 4713 Bockum-Hövel, Fed. Rep. of Germany

[21] Appl. No.: 248,681

[22] Filed: Mar. 30, 1981

[51] Int. Cl.[3] ..... F27D 1/18; C10B 25/22; C10B 31/00; F23M 7/00

[52] U.S. Cl. ..... 432/250; 110/173 R; 202/250; 202/251

[58] Field of Search ..... 432/250; 110/173 R, 110/181; 202/248, 250, 251

[56] References Cited

U.S. PATENT DOCUMENTS 1,072,857 9/1913 Kickert ..... 202/248
2,920,017 1/1960 Limberg ..... 202/248

FOREIGN PATENT DOCUMENTS 1451560 3/1969 Fed. Rep. of Germany ... 110/173 R
2361495 6/1974 Fed. Rep. of Germany ..... 202/248

*Primary Examiner*—John J. Camby
*Attorney, Agent, or Firm*—Jon M. Lewis

[57] ABSTRACT

In a coke oven of the type having a plurality of filling shafts with openings and caps therefor at the oven roof, in order to reduce the temperature gradient and heat losses at the roof of the coke oven, the caps of the filling shafts are each directly mounted on fire-resistant brickwork rather than a metallic frame; also, the associated caps are each made of ceramic material with optional reinforcement and include a metal insert which is heat insulated from the oven by a heat barrier. The metal insert facilitates magnetic hoisting of the cap during unloading and loading of the oven and is provided with an adjoining layer of fired clay and felt. The engaging surfaces of the cap body and the brickwork of the filling shaft opening are preferably conical and define an annular recess on the outside for pouring cement or the like to secure the cap in position and seal off the shaft.

14 Claims, 2 Drawing Figures

SEALING LID MEANS FOR COKE OVEN CHAMBER

FIELD OF THE INVENTION

The invention relates to coke ovens constructed out of brickwork and having filling shaft terminating at the oven roof through the brickwork thereof. The brickwork surrounding each filling shaft opening or hole, in general, has a brick lining which is fire-resistant and a frame on which rests a closing cap body which has hitherto been made of metal, e.g., cast iron or steel.

It is expedient from the point of view of maintaining increased coke production to provide magnetic hoisting facilities for each filling hole cap to facilitate hoisting the cap away from the filling hole opening during loading and unloading of the oven.

The filling shafts or holes are provided in such a number and so disposed at the roof of a coke oven that charging with coal can be achieved conveniently with trucks. Typically, there are provided four filling holes per coke oven when the chamber is 10 to 11 meters long, and even five filling holes when the length is 13 meters. As a rule, the filling shafts traversing the oven roof are built with fire-resistant bricks forming a wall. Each cap closing a filling hole, in addition to being made largely of a ferrous metal serving to lift the cap magnetically with hoisting equipment, is also generally provided with a hoop to allow safe mechanical holding in the event the hoist should fail.

In prior art practice, where caps are made of cast iron, each cap is placed in a frame of cast iron for closure of a filling hole. The frame is disposed on an enlargement of the opening provided across the cross section of a filling shaft; the shape of each opening is defined by several terminal bricks projecting radially inwards, typically four. These terminal bricks differ by their shape from the other bricks of the filling shaft, especially by the faces exposed around the filling hole. These faces are so designed that they can receive and support an associated frame which, once mounted, is generally secured in position with fire-resistant cement.

BACKGROUND OF THE INVENTION

In practice, invariably there are heat losses through the filling hole caps, by direct conduction and dissipation, and also otherwise, such as by leakage. Heat losses through filling hole caps are undesirable from more than one viewpoint. Obviously heat losses through the caps represent needlessly wasted energy and consequent loss of money. Furthermore, it has been observed that the caps which are usually made of cast iron or steel, warp because of thermal stress reversal in the course of several loadings and unloadings of a single shaft. The warp results in gaps at the periphery of the cap, further augmenting the heat loss. It is customary in coke oven installations to provide a flexible metallic seal, e.g., of stainless steel sheet metal, to facilitate good sealing action; notwithstanding, the warping suffered by the cast iron or the steel lid causes the metallic seal to be ineffective. As a consequence, not only are the heat losses from the cap increased, but also, hot gases containing a profuse amount of dust and other entrained particles are let out into the atmosphere. In most instances environmental regulations necessitate installation of equipment to filter the hot gases to get rid of the dust and other entrained particles; such installation again results in expenses and additional needless investment without proper returns.

There is yet another consideration why heat conduction and consequent heat loss should be prevented from the filling hole cap. As mentioned earlier, it is known practice to lift the cap magnetically during filling the shaft, as well as during unloading. In the event of totally ferrous lid if a permanent magnet is used for the hoisting or lifting of the cap, the magnet would tend to undergo premature demagnetization because of exposure to high temperatures, as is well known to those who are skilled in the art. If, on the other hand, an electromagnet is used for hoisting, design provisions would have to be made in the electromagnet for exposure to extremely high temperatures; such design provision may be in the form of increased cross sectional area of the conductor of the electromagnetic winding, consequently rendering the equipment relatively expensive. Looked at from various angles, heat conduction, dissipation and consequent heat loss through caps of filling shafts of coke ovens are always undesirable.

Attempts to construct the caps exclusively from ceramic material would result in brittleness and loss of mechanical strength. Besides, a cap made totally of ceramic material would lose the ability of magnetic hoisting, which is a very convenient feature. There has been a need for a cap construction for use with filling holes of coke ovens, which construction permits magnetic hoisting, and at the same time cuts the heat losses to a negligible amount, obviating all the attendant disadvantages. An experimental set-up wherein a metallic cap on a filling hole was completely removed and was replaced by brickwork to seal the cap-opening indicated that the heat losses through the cap area were minimal when there was no metal around the cap or in the cap whatsoever, which was directly exposed to the inside of the coke oven. It seemed extremely desirable to extend the heat loss prevention to the area around the cap also; accordingly, a frame built of ceramic material or other firebricks was tried out in conjunction with a cap constructed according to this invention, resulting in further reduction of heat loss. Repeated opening and closing of the cap in an arrangement where the frame surrounding the cap is also made of firebrick does not result in any undue wear of either the frame opening or the cap-seating, since they are both made of similar materials. On the other hand, if the cap were made exclusively of cast iron or steel as in prior art arrangements, invariably the frame opening is made of metal, too, to prevent undue wear; such arrangement results in excessive heat losses because of thermal conduction both through the metallic cap and the surrounding metallic frame. The present invention makes it feasible to construct a ceramic frame opening and a cap substantially made of ceramic material, at the same time retaining the advantages and desirability of magnetic hoisting of the cap during loading and unloading of the coke oven.

SUMMARY OF THE INVENTION

The present invention stems from the discovery and realization that the elevated temperatures which predominate at the working location of the oven roof could be substantially lowered if the heat escaping from the metallic portions of the various filling hole closing caps and frames could be eliminated. Hitherto, the notion had been mainly that the temperature gradients at the working locations of the oven roof were due essentially to the parts of the oven roof which are made of ceramic bricks, these being considered as constituting the bulk of the surface radiating heat. However, it was discovered quite unexpectedly during certain repair work done to an oven chamber that the filling hole cap, when purposely heated, caused scaling to occur in the neighboring oven chamber, whereas if the cap is taken away and replaced by brickwork, like for the filling holes, a substantial reduction of the temperature is observed on the oven roof.

The present invention translates into practice this discovery and applies it to normal operation of a coke oven to provide improved filling hole caps such as described herein.

The invention in its broad form resides in an arrangement for a coke oven having a fire-resistant brickwork construction, wherein the arrangement is for a filling hole closure for closing filling shafts traversing the oven roof, said arrangement comprising: a lid body resting on a frame mounted on each filling hole; said lid body being provided with a metal insert inlaid in the lid body for facilitating lifting the lid; said frame comprising a terminal brickwork built surrounding an opening of each filling hole; each lid body including heat-insulating means disposed between the metal insert and the lid body to prevent heat transfer from the lid body to the metal insert, and means to fasten the metal insert to the lid body.

In a preferred embodiment of the invention described herein, the problem of heat loss is solved partly by building as a unit, around the filling hole, a terminal brickwork serving as a frame on which to mount the closing cap and by forming each cap body as a fire-resistant stopper extending across and covering the filling hole; each cap is provided with a metal insert mounted therein with a heat-insulating barrier. As a result, heat radiation which occurred up to now with metallic frames of prior art constructions is now eliminated. While prior art constructions up to now could not achieve a sufficiently low temperature on the oven roof, a larger and significant temperature reduction is achieved, according to the invention, through a frame and a cap body made of material which is fire-resistant so that the metal insert becomes thermally insulated, thus preventing the cap from dissipating excessive heat.

Preferably, and in accordance with a further feature of the invention, the frame is built as a plate-structure having faces which basically define laterally the opening of the filling hole. Such a plate can be cemented easily on the filling shaft as terminal brickwork ending flush with the oven deck. In this manner, the filling hole has an internal contour which can either have several facets laterally, or be circular.

According to a further feature of the invention, the openings of the filling holes are formed as truncated cones while the associated cap bodies are given a double cone shape profile which closes with a matching cylindrical end surface, which feature serves to firmly seat the cap body in position.

It is typical of this particular construction that a shedding cup is obtained on the oven roof used to seal the stopper so that any escape of smoke from the filling shaft is prevented. Another advantage with this construction is that the stopper can be guided and centered into place automatically so that the cap can be placed readily in its desired position.

According to another feature of the invention, the metal insert which forms part of the cap is provided with radial arms for the purpose of preventing the cap from accidentally falling through the filling shaft. Specifically, should the hoist equipment fail while lifting the cap causing the matter to fall into the filling hole, the ceramic material of the cap body could break, but the radial metal arms will lay across the truncated cone-shaped zone of the filling hole and prevent the metal insert from falling into the oven chamber.

In the illustrated embodiment, heat insulation of the metal insert is facilitated according to the invention by a recess provided in the frontal face of the ceramic cap serving to receive the metallic insert which may be in the form of a plate sunk into and assembled in the recess on the top of a layer of fire-resistant felt. Parallel apertures are provided through the cap body and the metal insert through which apertures are passed metal anchors or fasteners for the metal insert. At the underside of each ceramic cap, recesses aligned with the apertures are provided to be filled with fire-resistant plugs in order to prevent heat transmission and loss through the metal anchors.

DESCRIPTION OF THE PREFERRED EMBODIMENT

Figure 1:
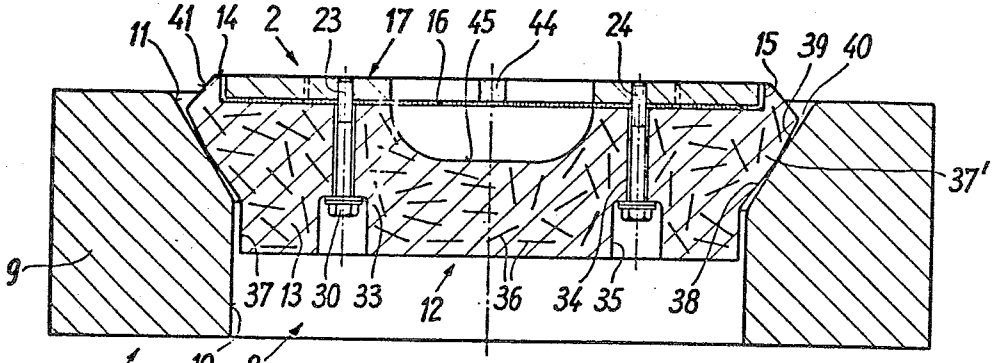
FIG. 1 shows in elevational cross section a filling hole cap according to the invention.

Referring to FIG. 1, a plate is shown mounted upon a filling shaft (not shown), and, the closing cap rests on a frame generally designated as 1. The frame and the cap close the filling hole hermetically. The frame, as illustrated, has basically four faces. The frame with its four sides (4–7) surrounds the filling hole generally designated by 8. The central hole of the frame is illustratively shown to be circular. The frame which consists of fire-resistant material, for instance of ceramics, can be cemented with the adjoining brickwork (not shown) of the oven roof and the filling shaft, which consists of the same or of a similar material. In this manner, frame 1 serves as terminal structure of brickwork for the shaft which surrounds the filling hole. The aperture of the filling hole has an inner cross section 20 which is constituted by a cylindrical mantel. It continues further with an outer cross section 11 which has the configuration of a conical surface.

Lid 2 has a body 12, which extends as a fire-resistant stopper 13 which in use hermetically closes the filling hole 8. On the upper side 14 of the cap-body is a recess 15, which recess contains a lining 16 of fire-resistant material which may comprise felt; alternatively the material may include conformed fire clay which serves as heat insulation. The fire-resistant material also serves to prevent the building up of heat stresses between certain metallic parts described hereafter.

Figure 2:
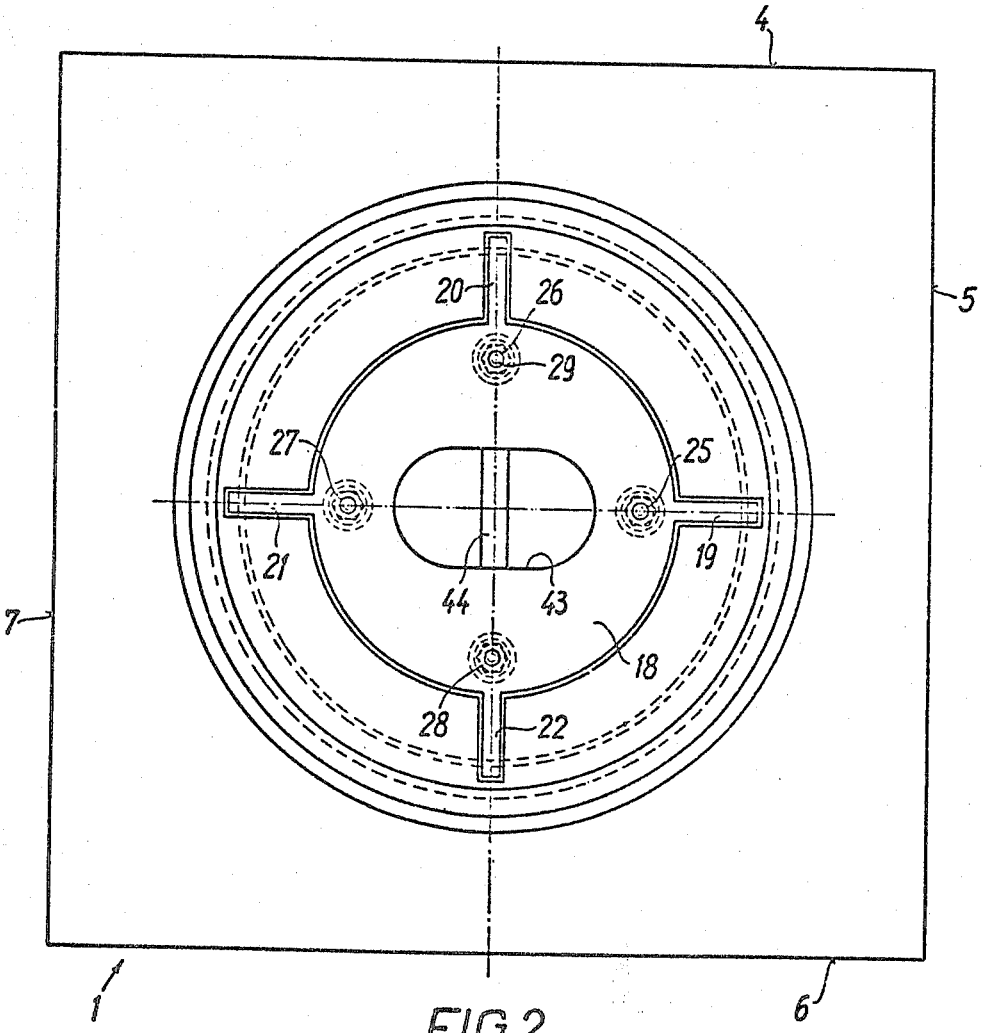
FIG. 2 is a plan view from above of the cap of FIG. 1.

As illustrated, the metal insert 17 forms the top portion of the assembled cap and facilitates magnetic hoisting. This metal insert has a central portion 18 (FIG. 2) generally in the form of a cross having several (four in the example shown) arms (19–22) at equal angles. These arms are so dimensioned that the lid, by virtue of its metal insert 17, and the projecting arms, cannot fall through the filling shaft (not shown) in the event that the stopper 12 is broken. Further, as illustrated, the metallic parts include four anchors 23, 24 which are in the form of screw bolts. The threaded ends of the bolts are passed through borings (25–28) having complementary inner threads 29, as shown in FIG. 2.

The heads of anchors 23, 24 typically are hexahedral heads 30 of the screw bolts pressing against underlying washers 33. The cap body 12 is provided with recesses for each of the anchors shown in two instances at 23, 24 in FIG. 1. Of these recesses, one is an inner recess 34 of even cylindrical cross-section; the other is an outer recess 35 also of cylindrical cross-section, but of larger and wider cross-section than recess 34. The cross-section of recess 35 is advantageously filled with fire-resistant cement after the anchors 23, 24 have been installed in place. As a result, heat conduction through the anchors 23, 24 from the inside of the shaft towards the outside is eliminated.

The cap or stopper body may consist of ceramic material with internal reinforcements which may comprise, for instance, steel needles 36; other alternative forms of reinforcement are conceivable, too. When the stoppers are heat-treated and compressed, a very high mechanical strength is achieved.

The cap or stopper extends on its lower side as a cylindrical section 37 which is complementary to the cylindrical cross-section 10 of the filling hole 8, and it widens at its upper portion into a conical section 37. This conical cross-section is in turn formed of two conical surfaces 38, 39 which converge outwardly. As a result, at 40 a cup is formed against frame 9 which can be used for pouring cement to seal and prevent the escape of smoke from the filling shaft. The pouring cup 40 is completed by an inward conical end section 41 of the stopper body.

According to the embodiment illustratively shown, the metal insert 17 possesses a longitudinal recess which defines a cavity 45 across which is provided a transversal bar 44. The bar and recess serve the purpose of enabling mechanically lifting the lid in case the magnetic hoist equipment should fail to hold the metal insert 17.

Other configurations for the cap and the filling hole are conceivable so long as essentially the heat loss prevention is achieved using the concept of the present invention. Alternative arrangements for the metal insert, and for fastening the metal insert and the ceramic body are considered within the scope of the present invention, so long as the cap construction includes insulating structure to prevent heat conduction from the cap-body to the metal insert, and provided heat absorption by the fasteners from within the oven is prevented.

What is claimed is:

1. A coke oven of the type comprising brickwork and a plurality of filling shafts terminating at the oven roof through the brickwork, said filling shafts being used for loading and unloading purposes as desired, each said filling shaft having a refractory terminal structure and being provided with a closing means in the form of a removable lid, each said lid being adapted for being hoisted away from the oven roof during loading and unloading, each lid having a construction comprising:

a lid body substantially in the form of a ceramic plate adapted to rest on an opening of the filling shaft terminal structure, said lid body having a recess formed by a circumferential ridge;

a plate-like metal insert provided in said recess in the lid body for facilitating hoisting of the lid during loading and unloading, said plate-like insert having a diameter substantially smaller than a diameter of a said filling shaft;

support means provided on the metal insert in the form of a plurality of radial extensions from a periphery of said plate-like insert, said radial extensions being embedded in the ceramic lid body, to prevent the plate-like metal insert from falling through the filling shaft;

heat-insulating means disposed between the lid body and the metal insert, so as to prevent heat transfer from the lid body to said metal insert;

fastening means provided to fasten said metal insert and said lid body with said heat-insulating means substantially sandwiched there between.

2. A coke oven as in claim 1 wherein said fastening means comprises a plurality of heat-insulated bolts passed substantially perpendicular to the sandwiched metal insert and lid body, so as to prevent heat transmission from within the coke oven to said metal insert.

3. A coke oven as in claim 2 wherein the lid body is substantially disc-shaped and includes a periphery substantially complementary to a filling shaft opening which is conically tapered towards the inside of the coke oven.

4. A coke oven as in claim 3 wherein said lid body includes at its top a chamfered peripheral edge at the top, said chamfered peripheral edge forming part of a truncated conical shape coverging upwards, to form a peripheral annular channel-like tapered recess when assembled on an associated filling shaft terminal structure.

5. A coke oven as in claim 4 wherein the lid contains randomly oriented and randomly distributed reinforcing needle-like elements to enhance the mechanical strength of the lid, and wherein the heat-insulated bolts include bolt heads accommodated in recessed apertures in the ceramic lid, the recessed apertures being plugged with heat-insulating stoppers to cover the bolt heads after assembly of the metal insert together with the heat-insulating means and the ceramic lid.

6. In combination, a filling hole closure arrangement in the form of coke oven lid closing a filling shaft opening formed by terminal fire-resistant brickwork structure of a filling shaft of a coke oven, comprising:

a lid body substantially in the form of a ceramic plate adpated to rest on an opening of said terminal structure, said body including randomly distributed internal means to reinforce the lid body, said lid body having a plate-shaped surface-recess formed by a circumferential ridge around and at the periphery of said lid body;

a ferromagnetic metal plate insert disposed in said recess and fastened to said lid body for facilitating magnetic hoisting of the lid, said ferromagnetic plate insert having a diameter substantially less than said filling shaft opening;

support means provided on the metal insert in the form of a plurality for radial extensions from the periphery of said ferromagnetic plate insert, said extensions being embedded in the lid body;

heat-insulation means disposed in said recess between the lid body and the ferromagnetic plate insert so as to minimize heat escape to the plate insert from the coke oven shaft and lid; and heat insulated fastening means provided to fasten said ferromagnetic plate insert to the lid body with said heat-insulation means sandwiched therebetween, whereby in view of plate insert being of substantially smaller diameter than said shaft opening, the heat dissipation and heat loss at the ferromagnetic plate insert is substantially minimized.

7. Filling hole-closure arrangement according to claim 6, wherein said filling hole cavity is cylindrical and has an end cross section which is conically truncated, said lid body including a substantially complementary truncated cross section terminating in a cylindrical cross section serving to self center the lid body in the filling hole cavity during assembly for hole closure.

8. Filling hole-closure arrangement as in claim 7, wherein said lid body has a convex peripheral edge along its conically shaped truncated portion the circumferential ridge of the lid body forming an annular recess in association with a surface of said filling shaft opening wherein the annular recess does not contact said ferromagnetic insert.

9. Filling hole-closure arrangement according to claim 6, wherein said metal insert is generally disc-shaped and is provided with four radial arms of such dimensions as to insure that the lid will not fall through the filling hole cavity.

10. Filling hole-closure structure according to claim 9, wherein the frontal surface of said lid body is provided with a recess, said metal insert being in the form of a plate inserted in said recess at an upper face thereof, said heat-insulating means being disposed in the form of an insulation layer between the plate and the lid body.

11. Filling hole-closure arrangement according to claim 10, wherein said insulating means comprises a layer of fire-resistant felt, and wherein said fastening means includes metal anchors in the form of bolts passed through aligned apertures in the metal plate and the lid body, the bolts having bolt heads accommodated in countersunk holes provided in the lid body, the arrangement including heat-insulating stoppers closing the countersunk holes to prevent heat transmission through the bolt heads and bolts.

12. Filling hole-closure arrangement as in claim 6, wherein said metal plate insert includes means to engage a lifting hook.

13. Filling hole-closure arrangement as in claim 12, wherein said engaging means for a lifting hook comprises a transverse bar integral with the metal insert and disposed over a cavity to facilitate inserting a hook.

14. Filling hole-closure arrangement as in claim 6, wherein said reinforcing means comprises randomly oriented and randomly distributed steel needles disposed in the ceramic body of the lid.

* * * * *